US010648094B2

(12) United States Patent
D'Astolfo et al.

(10) Patent No.: US 10,648,094 B2
(45) Date of Patent: May 12, 2020

(54) INSULATION ASSEMBLY FOR ELECTROLYSIS CELL

(71) Applicant: ELYSIS LIMITED PARTNERSHIP, Montreal, QC (CA)

(72) Inventors: Leroy E. D'Astolfo, Lower Burrell, PA (US); Steven A. Czekaj, Pittsburgh, PA (US); Yimin Ruan, Pittsburgh, PA (US)

(73) Assignee: ELYSIS LIMITED PARTNERSHIP, Montreal (CA)

( * ) Notice: Subject to any disclaimer, the term of this patent is extended or adjusted under 35 U.S.C. 154(b) by 127 days.

(21) Appl. No.: 15/416,559

(22) Filed: Jan. 26, 2017

(65) Prior Publication Data

US 2017/0211196 A1 Jul. 27, 2017

Related U.S. Application Data

(60) Provisional application No. 62/287,011, filed on Jan. 26, 2016.

(51) Int. Cl.

| | |
|---|---|
| ***C25C 3/08*** | (2006.01) |
| ***C25C 3/06*** | (2006.01) |
| ***C25C 3/24*** | (2006.01) |
| ***C25C 3/18*** | (2006.01) |
| ***C25C 3/12*** | (2006.01) |
| ***C25C 7/00*** | (2006.01) |
| ***C25C 3/00*** | (2006.01) |

(52) U.S. Cl.

CPC ..... *C25C 7/005* (2013.01); *C25C 3/00* (2013.01); *C25C 3/085* (2013.01)

(58) Field of Classification Search

CPC .... C25C 3/08; C25C 3/06; C25C 3/24; C25C 3/18; C25C 7/005; C25C 3/12; C25C 3/00

USPC ..... 205/379

See application file for complete search history.

(56) References Cited

U.S. PATENT DOCUMENTS

2002/0074235 A1* 6/2002 D'Astolfo, Jr. ..... C25C 3/085 205/354

2003/0209426 A1 11/2003 Slaugenhaupt et al.

FOREIGN PATENT DOCUMENTS

| | | | |
|---|---|---|---|
| CN | 1 598 066 | A | 3/2005 |
| CN | 201 358 306 | Y | 12/2009 |
| CN | 204 080 126 | U | 1/2015 |
| EP | 2688130 | A1 | 1/2014 |

(Continued)

OTHER PUBLICATIONS

International Search Report and Written Opinion from International Application No. PCT/US2017/015099 dated Apr. 24, 2017.

*Primary Examiner* — Zulmariam Mendez

(74) *Attorney, Agent, or Firm* — Damien Calvet; Gowling WLG (Canada) LLP

(57) ABSTRACT

An insulation assembly is provided, including: a body of an insulating material with a lower surface configured to contact a sidewall an electrolysis cell; an upper surface generally opposed to the lower surface; and a perimetrical sidewall extending between the upper surface and the lower surface to surround the remainder of the body, the perimetrical sidewall including: an inner portion configured to face an anode surface of the electrolysis cell and provide a gap between the body and the anode surface of the electrolysis cell; wherein the body is configured to extend from the sidewall towards the anode surface.

32 Claims, 14 Drawing Sheets

(56) References Cited

FOREIGN PATENT DOCUMENTS

| | | | |
|---|---|---|---|
| RU | 2532792 | U1 | 11/2014 |
| RU | 152438 | U1 | 5/2015 |
| RU | 2570155 | C1 | 12/2015 |
| SU | 377 419 | A1 | 4/1973 |

* cited by examiner

INSULATION ASSEMBLY FOR ELECTROLYSIS CELL

CROSS-REFERENCE TO RELATED APPLICATIONS

This application claims the benefit of U.S. Provisional Application Ser. No. 62/287,011, filed Jan. 26, 2016, the contents of which are incorporated herein by reference in its entirety.

FIELD OF THE INVENTION

Broadly, the instant disclosure is directed towards insulation assemblies that can be used individually or in combination along portions of the side wall of an electrolysis cell to prevent heat loss. More specifically, the instant disclosure is directed towards insulation assemblies that are off-set from the anode assembly (e.g. anode or refractory package) and are retained in place by: a specific configuration of the insulation assembly promote the center of gravity towards the portion which overhangs the sidewall; a mechanical attachment to the sidewall or sidewall materials (e.g. deck plate, insulation, shell); and combinations thereof.

BACKGROUND

During operation, electrolytic cells are operated at high temperatures, such that the molten electrolyte in the electrolytic cells generates and radiates a lot of heat. Cell covers are employed to prevent heat loss from the cell and limit fluoride fume evolution.

SUMMARY OF THE DISCLOSURE

Broadly, the present disclosure related to various embodiments of insulation assemblies, where in each instance the insulation assembly is configured to provide insulation to an electrolysis cell, thus limiting heat loss and fluoride fume evolution from the cell. More specifically, the present disclosure is related to insulation assemblies that are configured to sit adjacent to but not in direct contact with an anode surface (e.g. anode assembly, anode support, and/or anode surface) such that the anode assembly is adjustable/removable without moving, adjusting, and/or changing the position of the insulation assemblies. In some embodiments, the insulation assembly is configured to sit on the upper portion of the sidewall without being mechanically attached (e.g. bolted/mechanically fastened) to the cell. In some embodiments, the insulation assemblies are positioned proximal to each other and the anode surface such that a solidified bath material forms between the gaps (e.g. between insulation assemblies and/or insulation assembly to anode surface) to further enclose the cell contents, where the formation of solidified bath between these components is such that, by adjusting the anode surface and/or one or more insulation assemblies, the solidified bath is broken with little force/effort.

In one aspect, an insulation assembly is provided, comprising: a body of an insulating material (e.g. refractory castable), the body having: a lower surface configured to contact a sidewall (e.g. deck plate or upper portion of) an electrolysis cell; an upper surface generally opposed to the lower surface; and a perimetrical sidewall extending between the upper surface and the lower surface to surround the remainder of the body, wherein the perimetrical sidewall includes an inner portion, wherein the inner portion is configured to face an anode surface (e.g. anode or anode assembly) of the electrolysis cell, wherein the inner surface is constructed of a non-metallic material; wherein the body is configured to extend from the sidewall towards the anode surface; wherein the inner surface is configured to provide a gap between the body and the anode surface of the electrolysis cell.

In one aspect, an insulation assembly is provided, comprising: a body (e.g. monolithic body) of an insulation material (e.g. high density insulation material), the monolithic body having: a lower surface constructed of a non-conducting material, wherein the lower surface is configured to contact a deck plate/upper portion of a sidewall of an electrolysis cell; an upper surface (generally opposed from the lower surface), the upper surface configured with a lift device (e.g. lifting lug, tow lines, etc), the lift device having an attachment site configured to allow attachment to the monolithic body and support the weight of the monolithic body when lifted from contact with the deck plate of the electrolysis cell; and a perimetrical sidewall extending between the upper surface and the lower surface, the perimetrical sidewall having an inner portion configured to face the open upper region of the electrolysis cell, wherein the inner surface is constructed of an insulating material (no metal); wherein the monolithic body of insulating material is configured to maintain non-contact with an anode assembly of the electrolysis cell.

In one aspect, an apparatus is provided, comprising: an electrolysis cell comprising: a cell bottom, at least one anode, at least one cathode, and at least one sidewall perimetrically surrounding the cell bottom, wherein the sidewall comprises: an inner face configured to retain a molten electrolyte and a top edge (e.g. sidewall and deck plate) wherein the sidewall has an upper portion; at least one insulation assembly configured to fit on the top edge of the sidewall and not contact an anode surface (e.g. anode body and/or anode assembly), wherein the insulation assembly comprises: a body comprising a non-metallic material, wherein the body comprises a lower surface contacting the top edge of the sidewall and an upper surface configured with a lift device.

In some embodiments, the gap is at least 2 mm to not greater than 10 mm.

In some embodiments, the gap is at least 2 mm; at least 3 mm; at least 4 mm; at least 5 mm; at least 6 mm; at least 7 mm; at least 8 mm; at least 9 mm or at least 10 mm.

In some embodiments, the gap is not greater than 2 mm; not greater than 3 mm; not greater than 4 mm; not greater than 5 mm; not greater than 6 mm; not greater than 7 mm; not greater than 8 mm; not greater than 9 mm or not greater than 10 mm.

In some embodiments, via the configuration of the gap, the gap is self-sealing (e.g. seals with solid/frozen bath).

In some embodiments, heat loss and fume loss are prevented via the insulation assembly.

In some embodiments, the body is at least 25 mm thick to not greater than 350 mm thick.

In some embodiments, the body is at least 25 mm thick; at least 50 mm thick; at least 75 mm thick; at least 100 mm thick; at least 125 mm thick; at least 150 mm thick; at least 175 mm thick; at least 200 mm thick; at least 225 mm thick; at least 250 mm thick; at least 275 mm thick; at least 300 mm thick; at least 325 mm thick or at least 350 mm thick.

In some embodiments, the body is not greater than 25 mm thick; not greater than 50 mm thick; not greater than 75 mm thick; not greater than 100 mm thick; not greater than 125 mm thick; not greater than 150 mm thick; not greater than 175 mm thick; not greater than 200 mm thick; not greater than 225 mm thick; not greater than 250 mm thick; not greater than 275 mm thick; not greater than 300 mm thick; not greater than 325 mm thick or not greater than 350 mm thick.

In some embodiments, the depression (e.g. including insulation) is not greater than 80% of the total height of the body.

In some embodiments, the insulation assembly comprises a side aisle refractory block.

In some embodiments, the body comprises: refractory; alumina based refractory, castable, silica based refractory, or any other material sufficiently corrosion resistant to fluoride fumes, and combinations thereof.

In some embodiments, the lower surface constructed of a non-metallic material.

In some embodiments, the body of insulating material is configured to maintain non-contact with the anode surface of the electrolysis cell.

In some embodiments, the low density material (e.g. insulation) is selected from the group consisting of: thermal blanket; alumina blanket; silica based blanket; and combinations thereof.

In some embodiments, the upper surface configured with a lift point (e.g. lifting lug, tow lines, etc).

In some embodiments, the lift point includes an attachment site configured to allow attachment to the body, wherein the attachment site is configured to support the weight of the body (i.e. without tilting the assembly during a lift event, i.e. when the body is lifted and/or adjusted).

In some embodiments, the body comprises a port (e.g. hole) extending through the body from the upper surface to the lower surface (e.g. alumina feed, sensor placement, tap hole, thermocouple, sampling port, inspection port, and combinations thereof, etc.).

In some embodiments, the port is configured to allow a feeder to insert a feed material into the cell via the port.

In some embodiments, the port is configured to allow a probe (e.g. sensor) to contact the molten electrolyte and obtain feedback from the cell operating conditions via the port.

In some embodiments, the assembly further comprises a cap, wherein the cap is configured to fit into and be retained in the port of the body.

In some embodiments, the cap comprises a refractory material (e.g. alumino-silicate refractory or low-cement alumina).

In some embodiments, the gap is retained in the port via gravity.

In some embodiments, the gap is retained in the port via a press-fit.

In some embodiments, the body comprises: a low density insulating material and a high density insulating material, wherein the lower surface and perimetrical sidewall comprise the high density insulating material.

In some embodiments, the body comprises a depression in the upper surface, wherein the low density insulating material is retained within the depression. In some embodiments, the depression is machined into the upper surface. In some embodiments, the body is cast, with the depression configured into the body as part of a monolithic body (e.g. produced via casting).

In some embodiments, the depression is configured proximal to the inner surface of the sidewall.

In some embodiments, the assembly comprises a cover, wherein the cover is configured to fit over the depression and retain the low density insulating material inside of the depression in the upper surface.

In some embodiments, the cover comprises: metal, stainless steel, aluminum, refractory board, mild steel, refractory castable, and combinations thereof.

In some embodiments, the assembly is configured to be retained on the sidewall via gravity (e.g. without mechanical attachment).

In some embodiments, based on the configuration of the body (i.e. total percentage of low density material, location of the depression and low density material), the center of gravity is configured closer to an outer surface (e.g. generally opposed to the inner surface facing the anode assembly) rather than the center of the assembly, such that the assembly rests on the sidewall without mechanical attachment.

In some embodiments, the body further comprises a mechanical attachment to the deck plate.

In some embodiments, the size of the port is at least 1 inch to not greater than 6 inches.

In some embodiments, the total percentage (cross sectional volume) of the insulation assembly that is low density insulation material is: at least 10% to not greater than 70%, as compared to the cross-sectional volume of the high density insulation material (e.g. body).

In some embodiments, the total percentage (cross sectional volume) of the insulation assembly that is low density insulation material is: at least 10%; at least 15%; at least 20%; at least 25%; at least 30%; at least 35%; at least 40%; at least 45%; at least 50%; at least 55%; at least 60%; at least 65%; or at least 70%, as compared to the cross-sectional volume of the high density insulation material (e.g. body).

In some embodiments, the total percentage (cross sectional volume) of the insulation assembly that is low density insulation material is: not greater than 10%; not greater than 15%; not greater than 20%; not greater than 25%; not greater than 30%; not greater than 35%; not greater than 40%; not greater than 45%; not greater than 50%; not greater than 55%; not greater than 60%; not greater than 65%; or not greater than 70%, as compared to the cross-sectional volume of the high density insulation material (e.g. body).

In some embodiments, the gap between the anode assembly and the inner surface of the assembly comprises a solidified bath (frozen cryolite).

In some embodiments, the body comprises at least one beveled edge.

In some embodiments, the body is generally rectangular.

In some embodiments, the lift device comprises a lift hook.

In one aspect, a method is provided, comprising: directing electrical current from at least one anode through an electrolytic bath having a feed material therein to a cathode, the bath having a temperature of less than 1000° C., wherein the bath is retained by a sidewall, the sidewall configured with a plurality of insulation assemblies positioned perimetrically around the upper edge of the sidewall; electrolytically reducing the feed material to produce a non-ferrous metal; adjusting the at least one anode in a vertical direction (e.g. upwards or downwards), such that, during the adjusting step, the insulation assemblies are maintained in position on the sidewall.

As used herein, "insulation assembly" means: an assembly of a one or more materials that is used to prevent or reduce the passage, transfer, or leakage of heat. In some embodiments, the insulation assembly also promotes containment of exhaust fumes and/or corrosive gases to one side (e.g. the lower end) of the insulation assembly.

As used herein, "body" means: an object having a specific structure and material.

As used herein, "refractory castable" means: a cast material that is heat resistant at high temperatures (e.g. furnaces or electrolytic cells). In some embodiments, the body comprises a fluoride-resistant material (e.g. low-cement alumina, alumino-silicate refractory).

As used herein, "non-metallic" means: a material that does not have any metal.

In some embodiments, the high density insulation is different from the low density insulation (e.g. in at least that the high density insulation has a higher density than the low density insulation).

Non-limiting examples of "high density insulation" include: refractory castable, refractory, and combinations thereof. Some non-limiting examples of compositions of high density insulation materials include: alumina, silica, aluminosilicates, calcium aluminates, or other appropriate chemistries, or combinations thereof.

Non-limiting examples of "low density insulation" include: thermal blanket, refractory blanket; board insulation, loose granular materials, refractory castable materials, and combinations thereof.

As used herein, "port" means: an opening through an object, e.g. to allow equipment to transgress or monitoring to occur on one side of the port from the other side of the port.

As used herein, "cover" means: something that covers something else. In some embodiments, the cover comprises the lid that retains the low density insulation (e.g. thermal blanket) inside the depression of the body.

As used herein, "access point" means: a hole in the cover and/or insulation assembly. In some embodiments, the access point in cap is smaller than the perimeter of the cap, such that the majority of the port is covered and only a proportionally smaller opening exists (via the access point).

As used herein, "cap" means: a covering for the port and/or access point.

As used herein, "depression" means: a portion that is lower than the surrounding surface of an object (e.g. the body).

As used herein, "lift device" means: a mechanical site that acts as a point of lifting on an object (e.g. the insulation assembly). Some non-limiting examples of lift devices include: lug lines, tow loops, eye hooks, hooks, lift bars, and the like.

In some embodiments, the positioning of the lift device and the depression(s) with low density insulation material cooperate to create a center of gravity in the insulation assembly. As such, the positioning of the (majority of the) high density insulation and location of the lift devices on the body (e.g. upper surface of the body) act as a counterweight to the lift point, such that the insulation assembly remains relatively flat (e.g. in position) as the insulation assembly is lifted, adjusted, and/or repositioned about a sidewall of an electrolysis cell.

In some embodiments, the percentage of insulation assembly that 'overhangs' the sidewall is: at 5%; at least 10%; at least 15%; at least 20%; at least 25%; at least 30%; at least 35%; at least 40%; at least 45%; at least 50%; at least 55%; at least 60%; at least 65%; at least 70%; or at least 75%.

In some embodiments, the percentage of insulation assembly that 'overhangs' the sidewall is: at 5%; not greater than 10%; not greater than 15%; not greater than 20%; not greater than 25%; not greater than 30%; not greater than 35%; not greater than 40%; not greater than 45%; not greater than 50%; not greater than 55%; not greater than 60%; not greater than 65%; not greater than 70%; or not greater than 75%.

In some embodiments, the percentage of insulation assembly that overhangs the sidewall is from 35% to not greater than 65% of the insulation assembly.

As used herein, "attachment area" (sometimes called attachment site) means: the location in which something is attached. In some embodiments, the attachment site refers to the cell sidewall (e.g. cell sidewall portion, shell, insulation, deck plate, or combinations thereof) onto which the insulation assembly is attached.

In some embodiments, mechanical fasteners (e.g. bolts, screws, brackets, etc) are used to attach the insulation assembly to the attachment area of the sidewall.

As used herein, "contact" means: the act or state of two objects touching (or meeting). In some embodiments, a portion of the lower surface of the insulation assembly contacts the sidewall. In some embodiments, the lower surface of the insulation assembly contacts the deck plate. In some embodiments, the lower surface of the insulation assembly contacts a solidified (frozen) portion of bath (e.g. on the surface of the sidewall or deck plate).

As used herein, "overhang" means: something that extends (projects) out over something else. In some embodiments, a portion of the insulation assembly overhangs the sidewall, such that it extends over the electrolyte bath and/or projects out towards the center of the cell from its resting position on the sidewall (or deck plate) of the cell.

As used herein, "perimetrical" means: the outer-most boundary of an object.

As used herein, "corrosion" means: the act or process of corroding.

As used herein, "cell" means: an electrolysis cell.

As used herein, "deck plate" means: the perimetrical, upper-most portion of the electrolysis cell body, which covers the shell, insulation (inner sidewall) and cell sidewall (e.g. hot face). As a non-limiting example, the deck plate includes the horizontal top rim of the pot shell.

As used herein, "sidewall" means: the wall (inner wall) of an electrolysis cell. In some embodiments, the sidewall runs perimetrically around the cell bottom and extends upward from the cell bottom to define the body of the electrolysis cell (and define the volume where the electrolyte bath is held). In some embodiments, the sidewall includes: an outer shell, a thermal insulation package, and an inner wall.

As used herein, "anode surface" means: the surface of the anode assembly. In some embodiments, the anode surface refers to the anode assembly (e.g. refractory material). In some embodiments, the anode surface refers to the surface of an electrode (e.g. anode) which directs current into the electrolysis cell.

Various ones of the inventive aspects noted hereinabove may be combined to yield one or more insulation assemblies and systems to combine the insulation assemblies, such that the insulation assemblies cooperate as a cell cover for an electrolysis cell.

These and other aspects, advantages, and novel features of the invention are set forth in part in the description that follows and will become apparent to those skilled in the art upon examination of the following description and figures, or may be learned by practicing the invention.

BRIEF DESCRIPTION OF THE DRAWINGS

FIG. 5A depicts a perspective view of another embodiment of an insulation assembly of the instant disclosure.

FIG. 5B depicts a top plan view of FIG. 5A.

FIG. 5C depicts a side plan view of FIG. 5A.

FIG. 5D depicts a cut-away side view taken along Section A-A of FIG. 5B.

FIG. 5E depicts an end plan view of FIG. 5A.

FIG. 5F depicts a cut-away side view taken along Section B-B of FIG. 5C.

FIG. 5G depicts a cut-away side view taken along Section C-C of FIG. 5C.

Referring to FIG. 13, the insulation assemblies are configured along the outer perimeter of the cell (e.g. sidewalls and corners) such that the plurality of insulation assemblies configured to cooperate with the anode surfaces (e.g. anode assemblies and/or anode bodies) to form a perimetrical cover which is configured to reduce, prevent, or eliminate heat loss from the cell. Also, it is noted that the insulation assemblies cooperate with the anode surfaces to provide a gap between the inner portion of each insulation assembly and the anode surface

DETAILED DESCRIPTION

Figure 1:
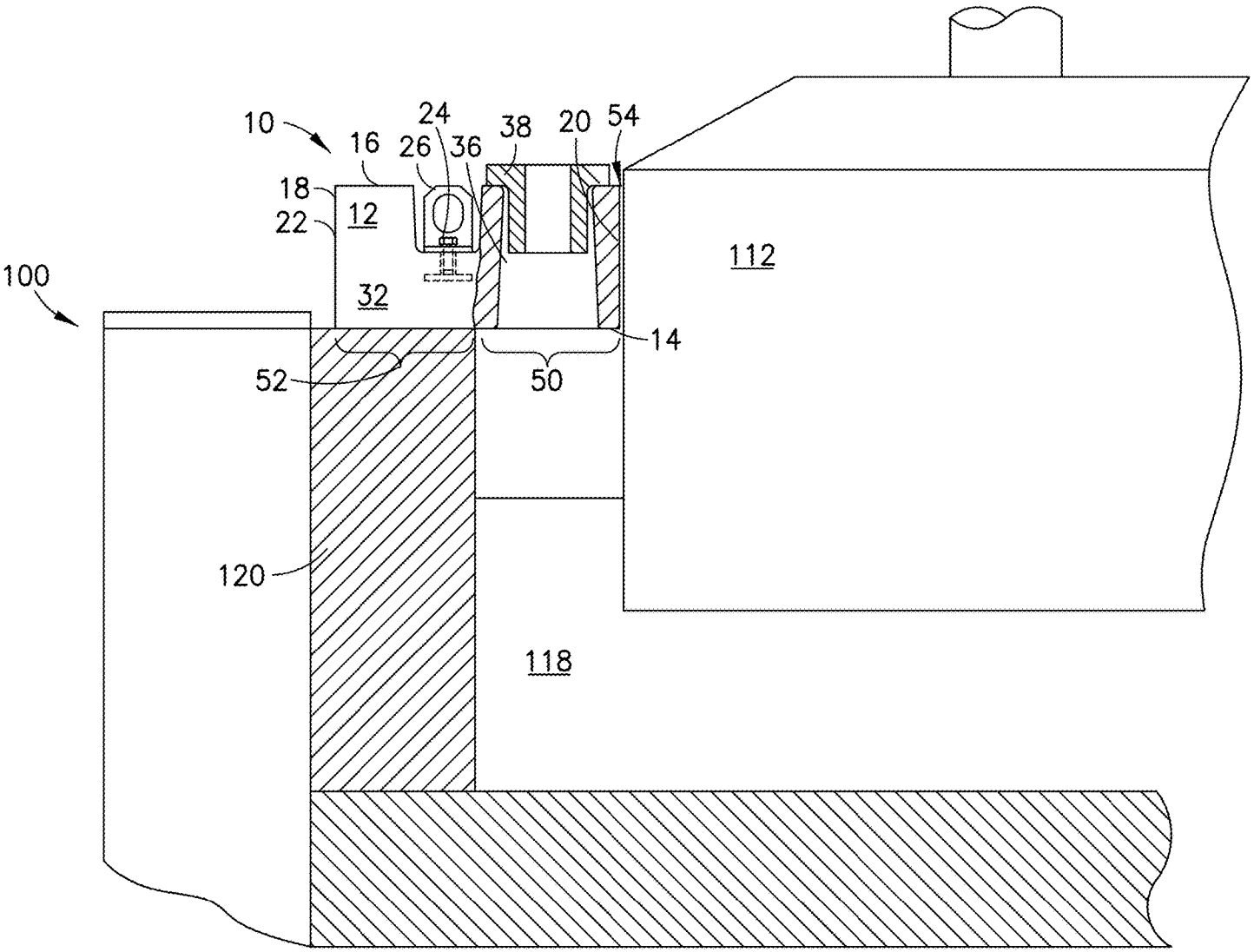
FIG. 1 depicts a cut-away side view of an embodiment of an insulation assembly of the instant disclosure, positioned on an electrolysis cell.

Reference will now be made in detail to the accompanying drawings, which at least assist in illustrating various pertinent embodiments of the present invention.

In some embodiments, the insulation assembly includes a high-density material (e.g. refractory) on a majority of the contact portion of the wall and at least a portion of low-density material (e.g. insulation, thermal blanket) on the overhang portion of the insulation assembly. With such a configuration, the insulation assembly has a center of gravity that is configured further back on the insulation assembly (i.e. towards the sidewall and away from the overhand portion), such that the insulation assembly is configured to sit upon the cell (e.g. refractory lining or edge of the electrolytic cell) and protrude over to the open, upper end of the cell such that the overhand portion is configured to cover (e.g. fully cover, but for the gap) the open upper portion of the cell such that the insulation assembly is configured to provide a barrier to in that the insulation assembly is configured to reduce, prevent, and/or eliminate the escape of exhaust fumes and/or heat from the electrolytic bath.

In some embodiments, the insulation assembly includes a high-density material (e.g. refractory) on a majority of the contact portion of the wall and (in some embodiments) at least a portion of low-density material (e.g. insulation, thermal blanket) on the overhang portion of the insulation assembly, where the insulation assembly is configured with an attachment area, the attachment area configured to promote mechanical attachment of the insulation assembly to the cell wall (e.g. deck plate, insulation, sidewall, or a combination thereof).

In some embodiments, the insulation assembly is configured with: a center of gravity positioned/aligned with the contact portion of the lower surface of the insulation assembly and an attachment area, configured to provide an area to mechanically attach the insulation assembly to the electrolysis cell sidewall.

Referring generally to the Figures, the insulation assembly 10 is configured with a body 12, the body 12 having a lower surface 14 and an upper surface 16 and a perimetrical sidewall 18 which extends between the upper surface 16 and the lower surface 14.

The lower portion 16 is generally split into two portions: an overhang portion 50 and a contact portion 52. The overhang portion 50 is configured to extend in an outward direction from the sidewall and contact the vapor interface above the bath 118, which is retained in the electrolysis cell 100. The contact portion 52 is configured to contact the sidewall 120 of the cell 100 (e.g. deck plate 122, insulation, shell, or combinations thereof).

The sidewall 18 is configured with at least two portions: an outer portion 22 and an inner portion 20, where the inner portion 20 and outer portion 22 are configured such that the inner portion 20 is adjacent to (e.g. spaced from, via the gap 54) the anode surface 112 and the outer portion 22 is adjacent to (e.g. positioned above and/or on) the sidewall 120 of the cell 100).

In some embodiments of the instant disclosure, the insulation assembly 10 is configured such that, when in place on the cell 100, there is a gap 54 between an inner portion 20 of the sidewall 18 of the assembly 10 and the anode surface 112. Without being bound by a particular mechanism or theory, the insulation assembly is configured such that the size of the gap is specifically configured to, during cell operation (e.g. heat up and/or operation) retain a portion of solidified bath 118 in the gap 54 (e.g. which vaporizes from the molten electrolyte 118), thus, creating a seal between the inner portion 20 of the insulation assembly 10 and the anode surface 112.

Similarly, without being bound by a particular mechanism or theory, the insulation assemblies 10 are configured to be positioned about the sidewall 120 such that there are specifically configured gaps between the insulation assemblies 10. These gaps between insulation assemblies 10 are configured to be sealed with solidified bath (e.g. during cell heat up and/or operation). It is noted that the solidified bath that is retained in the gap 54 and/or the gap between insulation assemblies (e.g. depicted in FIG. 13) has a thickness and strength sufficient to provide a barrier to the exhaust gases and/or heat which is radiating from the cell 100 and/or bath 118, but via the configuration of the insulation assembly 10 and cooperating gap 54 spacing, is configured to break upon adjustment of the anode surface 112 (e.g. in a vertical direction, upwards or downwards), such that the insulation assembly 10 remains seated on the sidewall 120 of the cell 100 and the anode surface 112 is able to be configured without restriction from the frozen bath portion in the gap 54.

Figure 10:
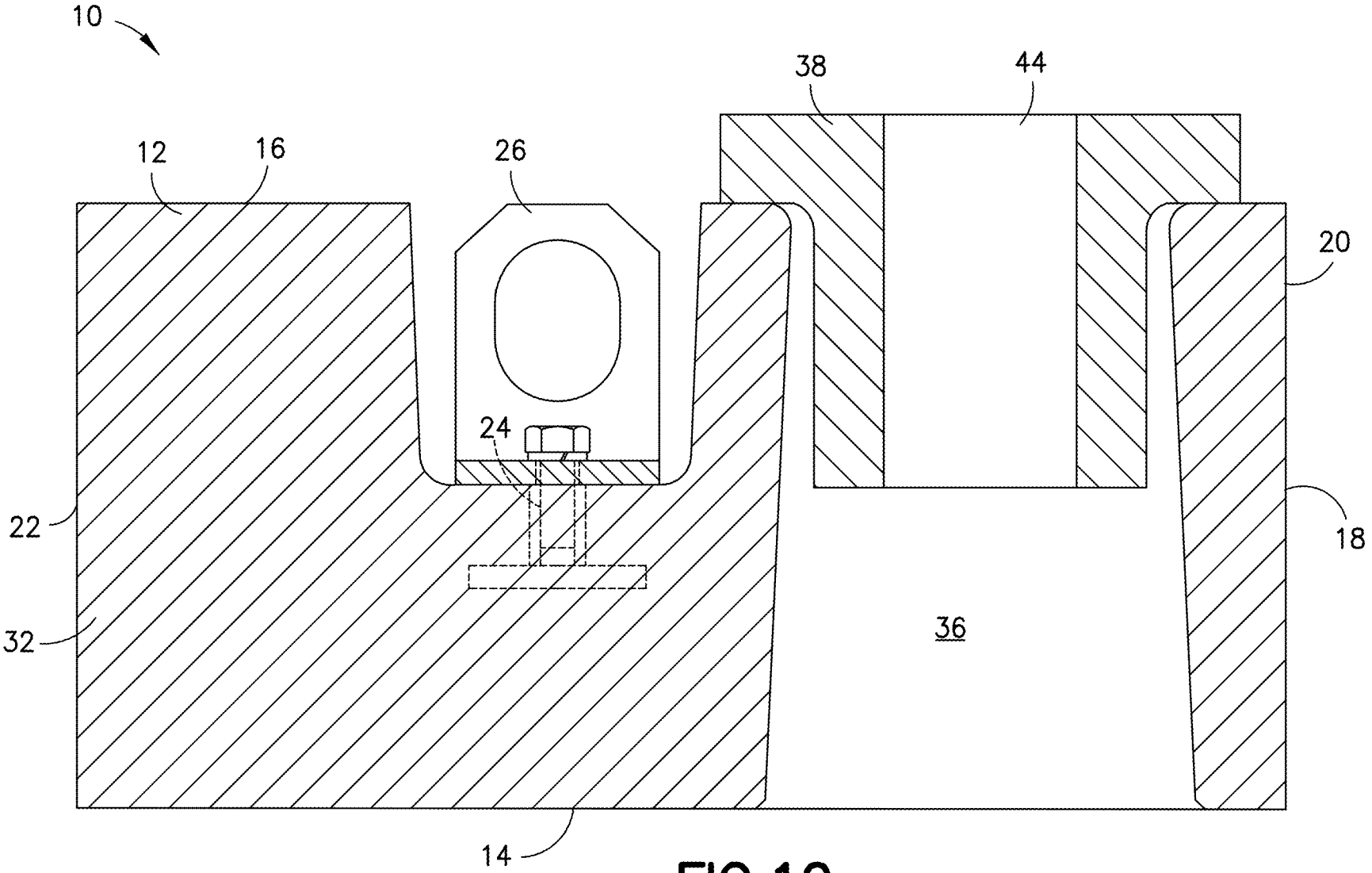
FIG. 10 depicts a close-up cut-away side view of the insulation assembly depicted in FIG. 1.

Referring to FIG. 1 (and FIG. 10), the insulation assembly 10 is configured with a port 36 which is configured to extend through the body 12 of the assembly 10, extending from the upper surface 16 to the lower surface 14 (e.g. overhang portion 50 of the lower surface). Also depicted in FIG. 1 (and FIG. 10), the port 36 includes a cap 38, which is configured to retain at least partially inside the port. As depicted in FIGS. 1 and 10, the cap 38 is further configured with a perimetrical extension which extends around an upper portion of the cap such that a collar is provided (e.g. configured to secure the cap 38 in place and/or prevent cap 38 from sliding through the port 36 into the bath 118/cell 100. As depicted in FIGS. 1 and 10, the cap 38 is provided with an access point 44, to allow access to the vapor space and/or bath 118 without removing either the cap 38 or the insulation assembly 10 from position. It is noted that the cap 38 is removably attachable from the port 36. The insulation assembly of FIGS. 1 and 10 is also configured with an attachment area 24 for a lift device 26, including a lift device 26 (e.g. a bolted in tow line). In FIG. 1, the insulation assembly 10 is configured with a center of gravity above the contact portion 52 of the lower surface 14, such that the insulation assembly 10 is retained on the sidewall/in place overhanging the cell 100 via gravity. In FIG. 1, a gap 54 is depicted between the inner portion 20 of the sidewall 18 of the insulation assembly 10 and the anode surface 112.

Figure 2:
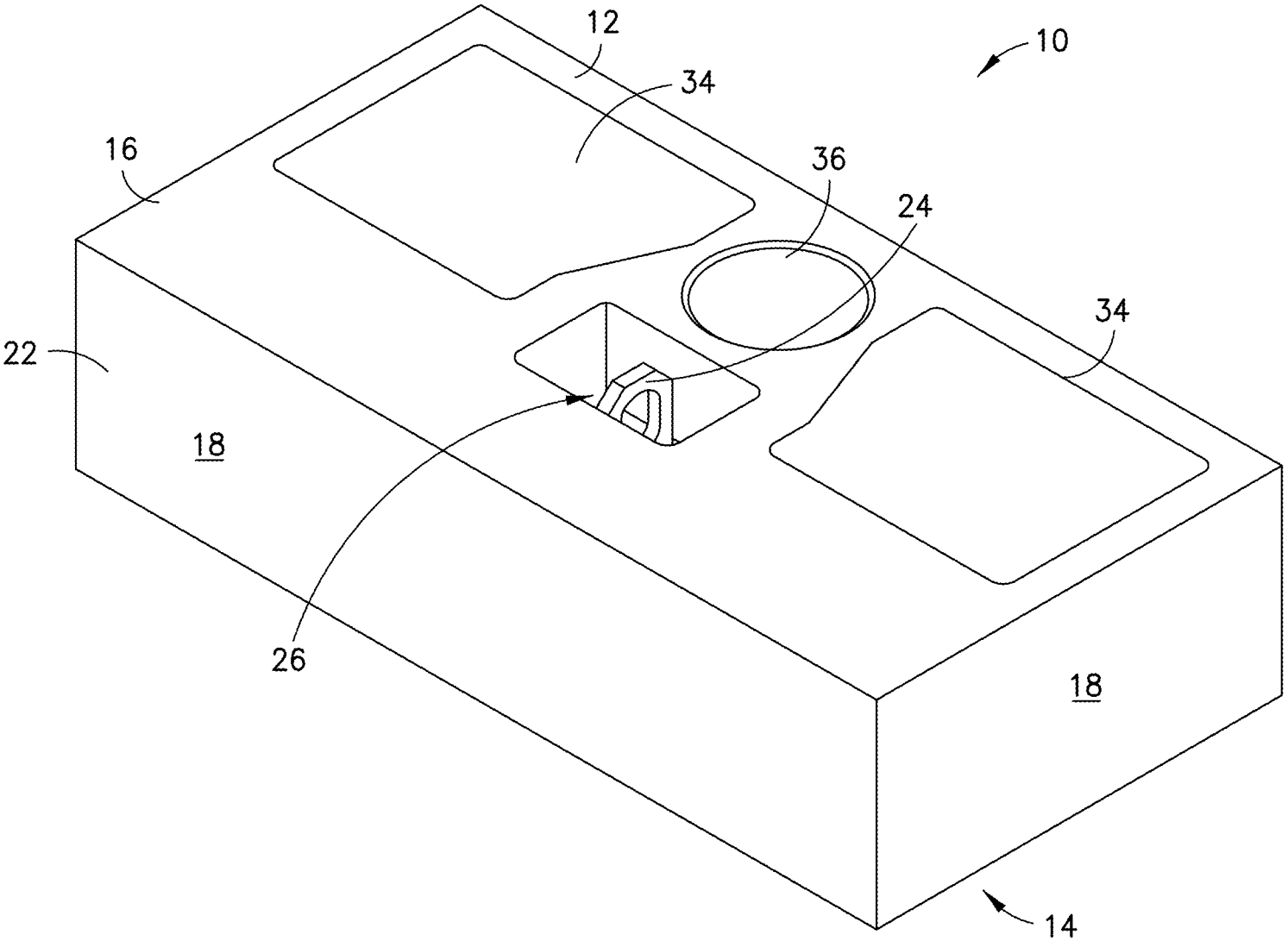
FIG. 2 depicts a perspective view of another embodiment of an insulation assembly of the instant disclosure, the insulation assembly including a work port.

FIG. 2 depicts a perspective view of another embodiment of an insulation assembly of the instant disclosure, basically, the insulation assembly 10 of FIG. 10 without a cap 38, such that the port 36 is depicted. FIG. 2 also depicts the covers 34, which are positioned on either side of the port 36, and configured to cover the low density insulation 32 (not shown) retained below the covers 34 (within the body 12 of the insulation assembly 10).

Figure 3:
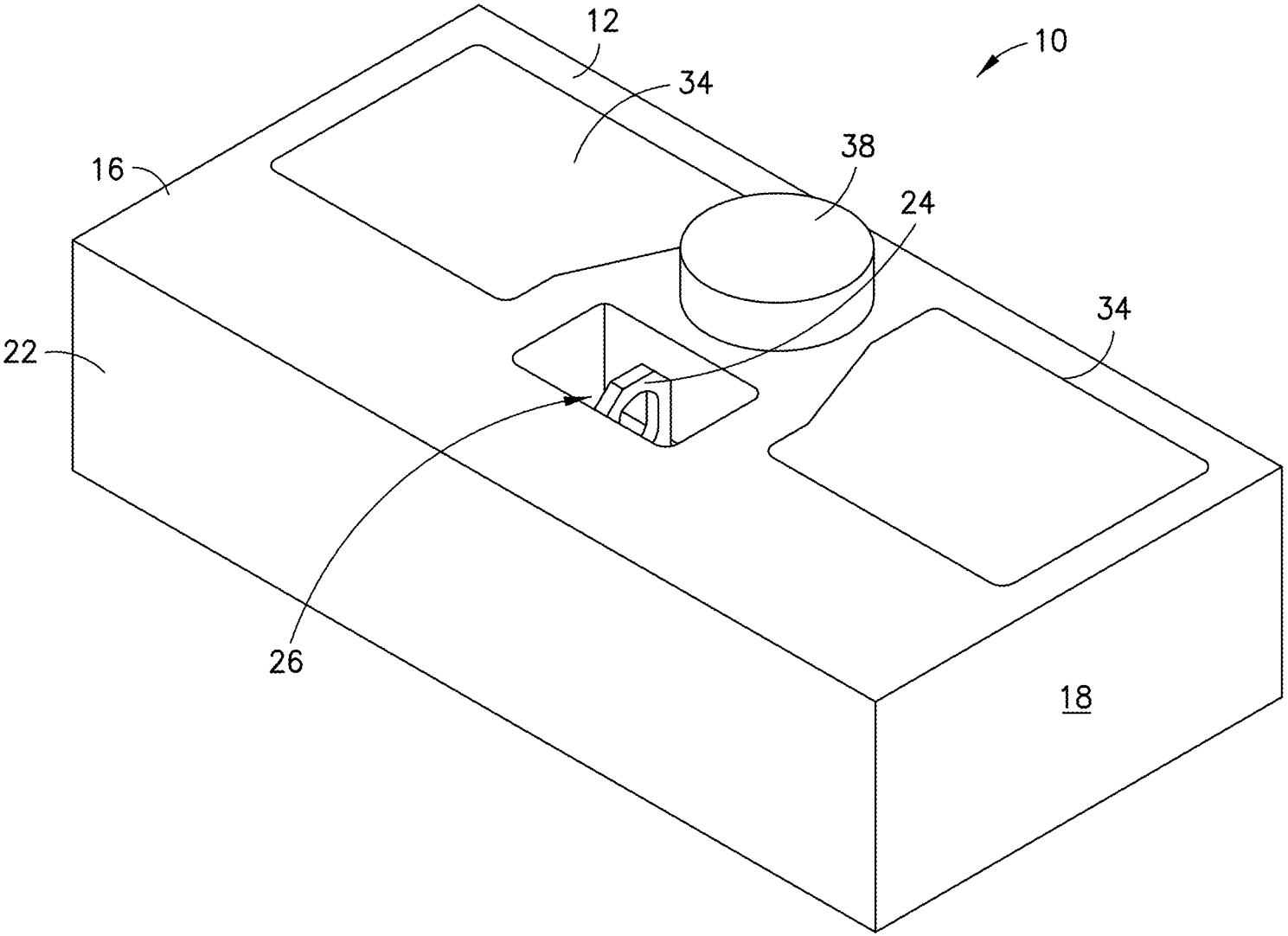
FIG. 3 depicts a perspective view of another embodiment of an insulation assembly of the instant disclosure, the insulation assembly including a work port with a cap configured in place to cover the work port.

FIG. 3 depicts a perspective view of another embodiment of an insulation assembly of the instant disclosure, basically, the insulation assembly 10 of FIG. 1 with a cap 38, where the cap does not have an access point 44 (e.g. the upper portion of the cap, is configured to completely cover the port 36).

Figure 4:
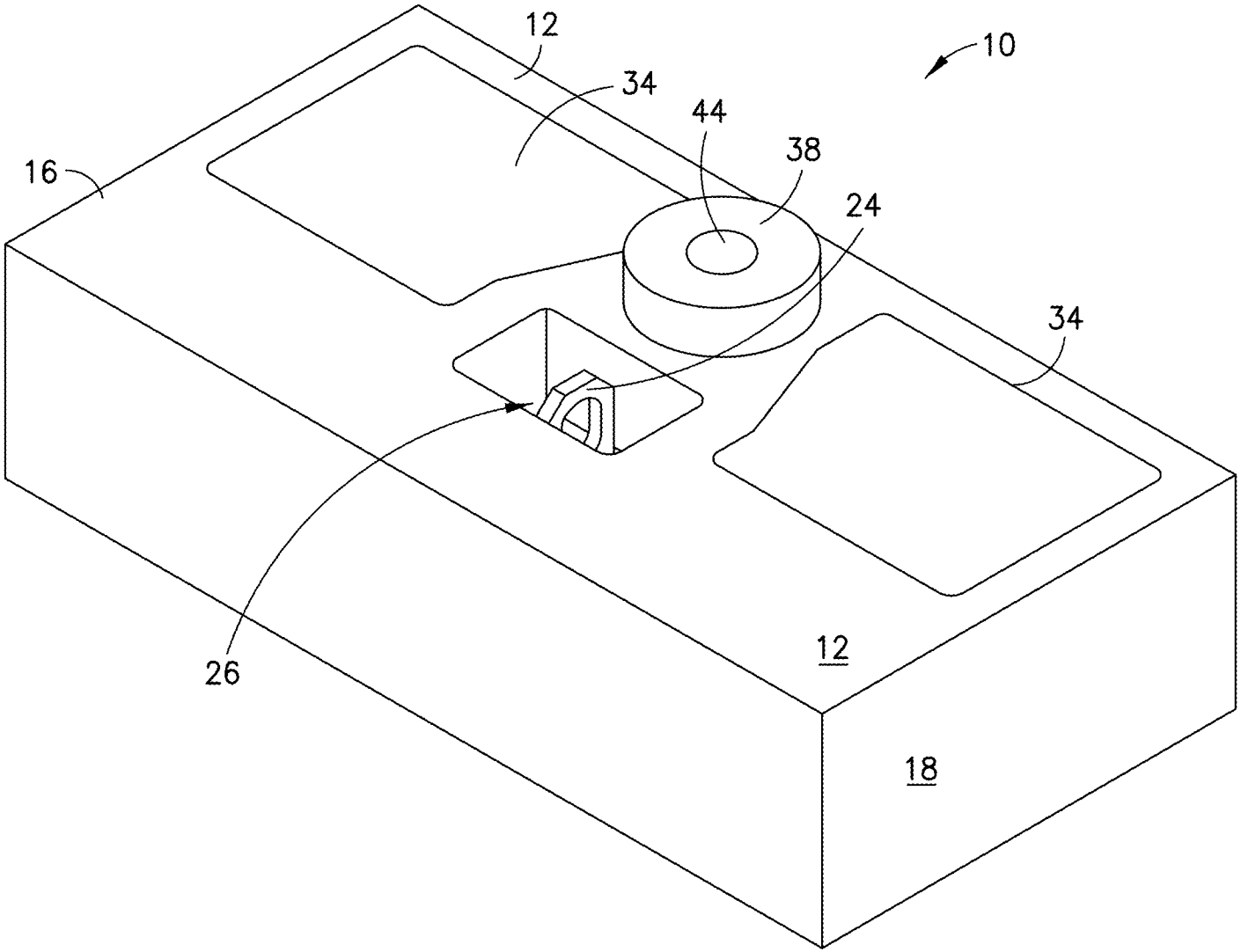
FIG. 4 depicts a perspective view of another embodiment of an insulation assembly of the instant disclosure, the insulation assembly including a work port with a cap configured in place to cover the work port, the cap configured with an access point.

FIG. 4 depicts a perspective view of FIG. 1, the insulation assembly 10 including a port 36 with a cap 38 configured in place to cover the work port, the cap configured with an access point 44.

Figure 5A:
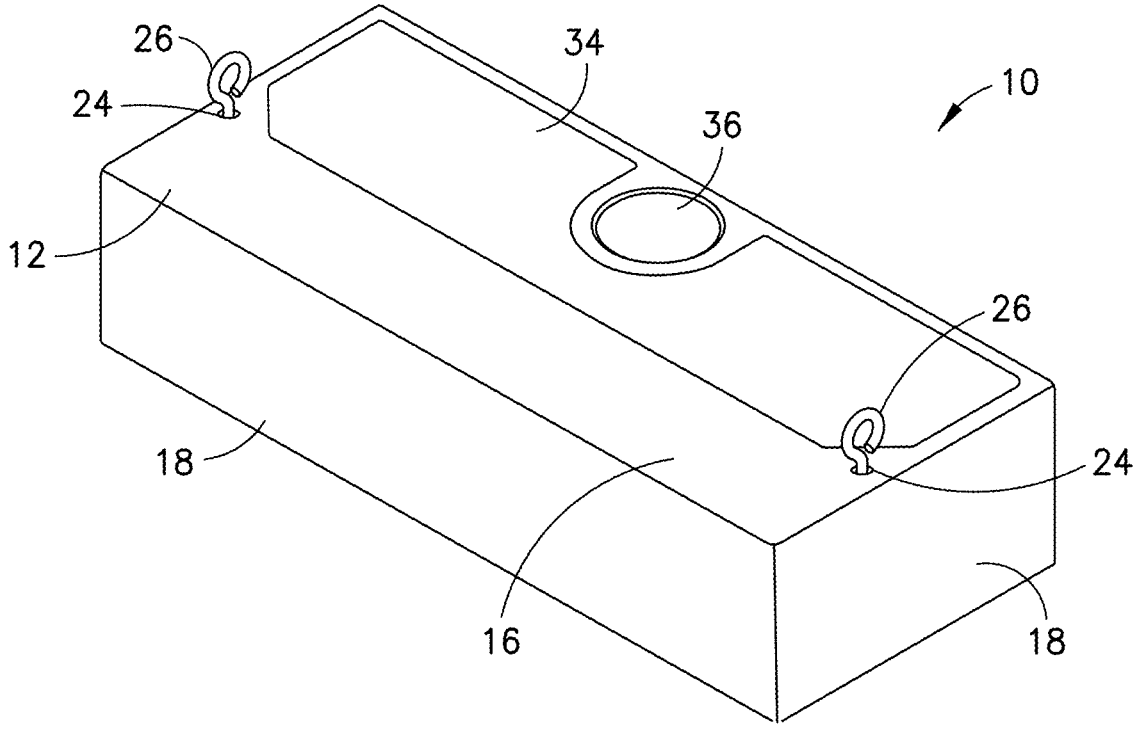
FIGS. 5A-5G depict a combination of perspective, plan, and cut-away side views of yet another embodiment of the instant disclosure, including lift devices and a work port.
Figure 5B:
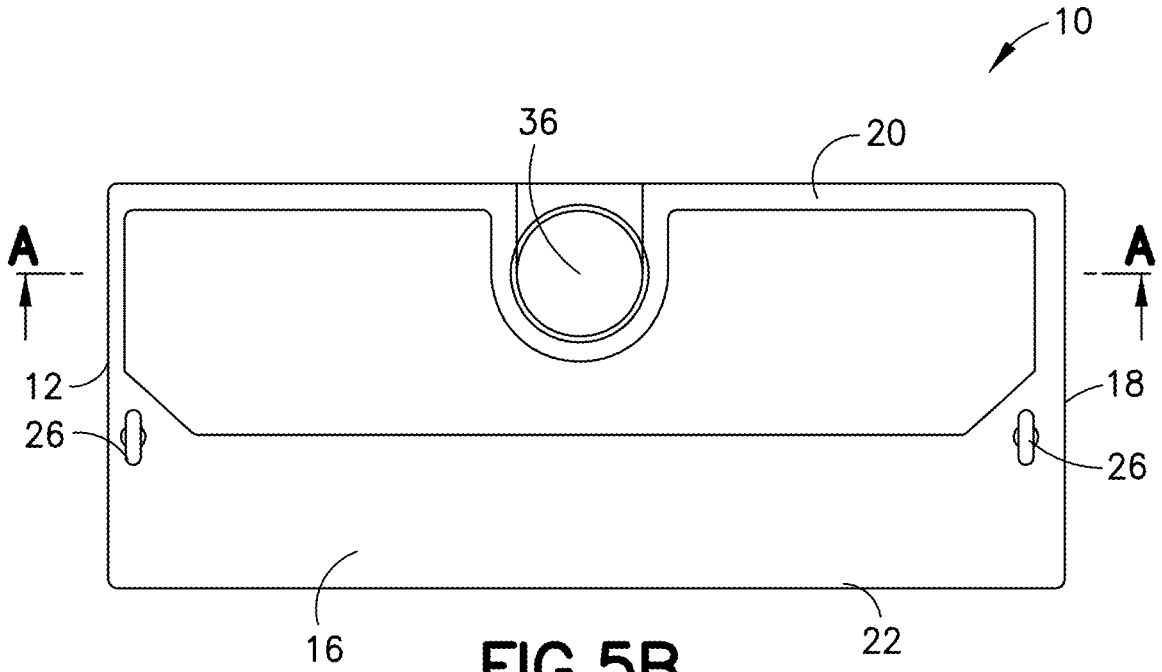
Figure 5C:
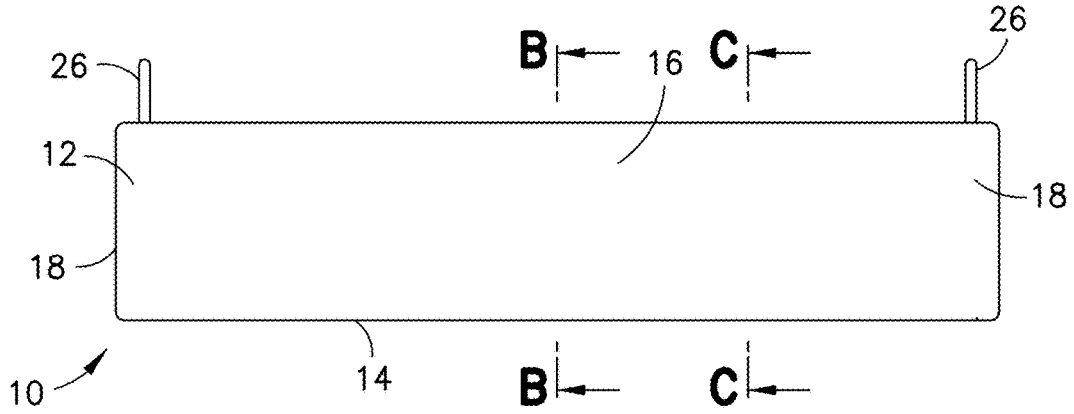
Figure 5D:
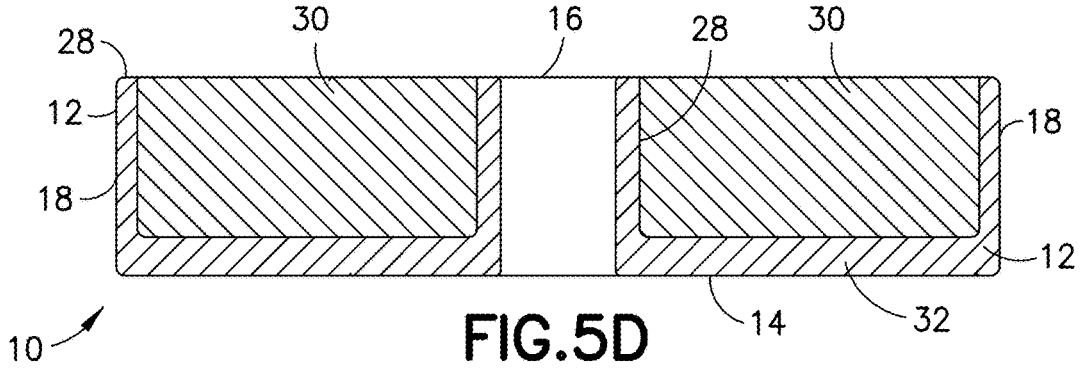
Figure 5E:
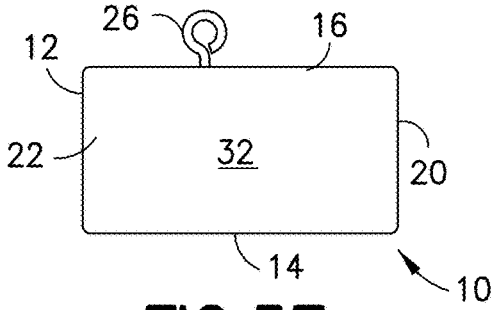
Figure 5G:
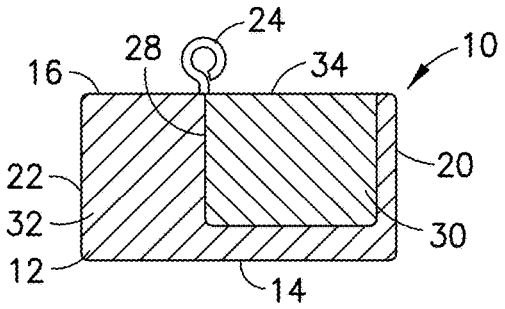
Figure 5F:
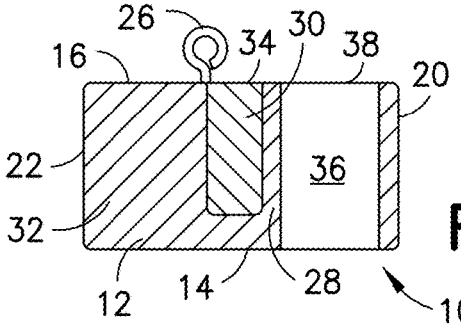

FIGS. 5A-5G depict a combination of perspective, plan, and cut-away side views of an insulation assembly 10, which is configured to include a plurality of lift devices 26 and a port 36, with a cover 34 that extends around the port 36 and over the majority of the upper surface 16 which is configured generally opposite to (e.g. juxtaposed to) the overhang portion 50 of the lower surface 14. FIGS. 5A-5C and 5E-G depict the lift device 26, an eye hook which is configured with a screw (opposite the eye hook) which is configured to mechanically attach to and secure the lift device 26 to the upper surface 16 of the insulation assembly 10. Also depicted in the cut-away side views of FIGS. 5D, 5F, and 5G are the low density insulation components 30 provided within the body 12, positioned within the depression 28 of the body 12. The low density insulation component 30 is configured to be retained within the body 12 via cover 34 (depicted in FIGS. 5A, 5B, and 5G).

Figure 6:
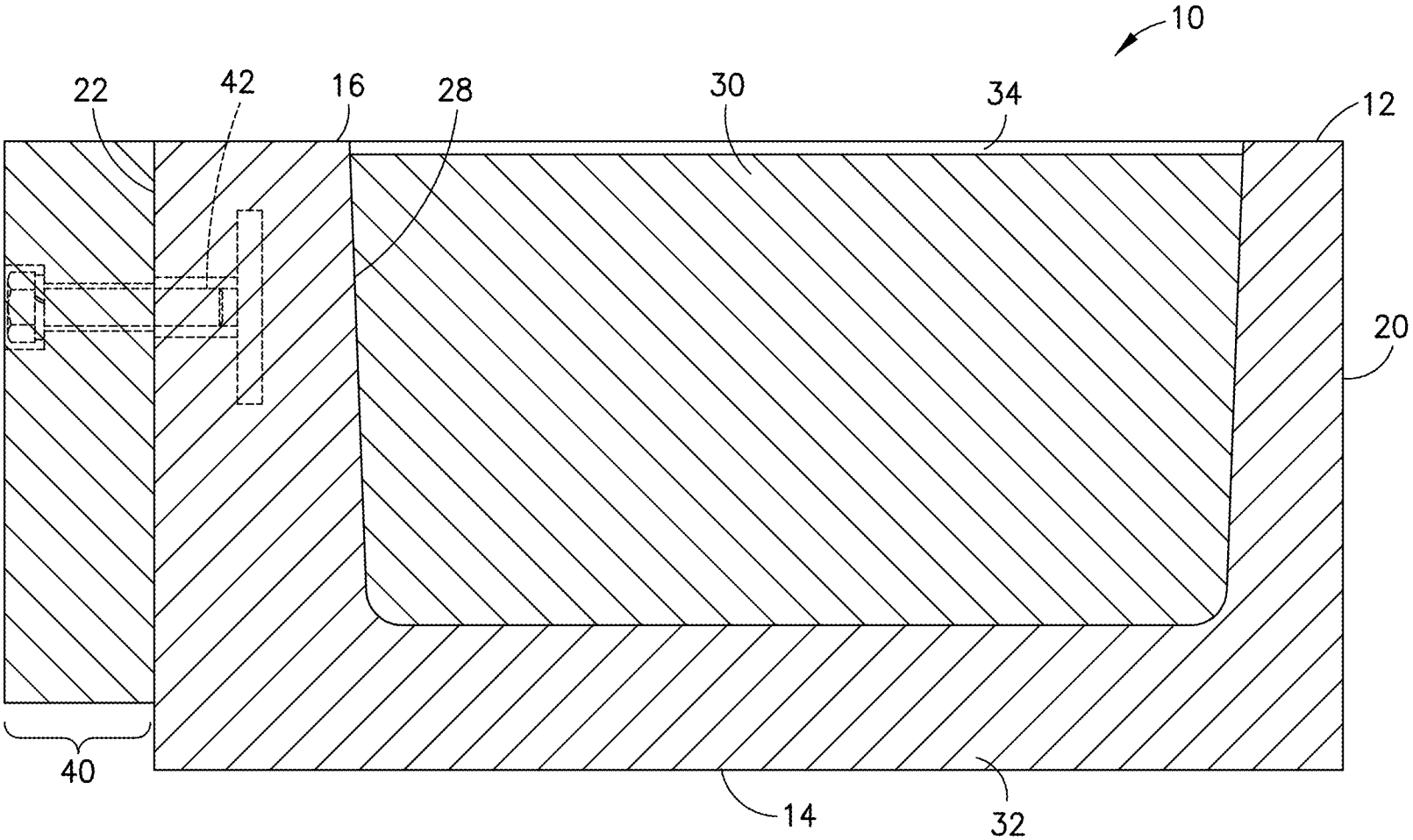
FIG. 6 depicts a cut-away side view of another embodiment of an insulation assembly of the instant disclosure, where the insulation assembly is configured with an attachment area (e.g. mechanical attachment device configured in the form of a bolt or screw).
Figure 7:
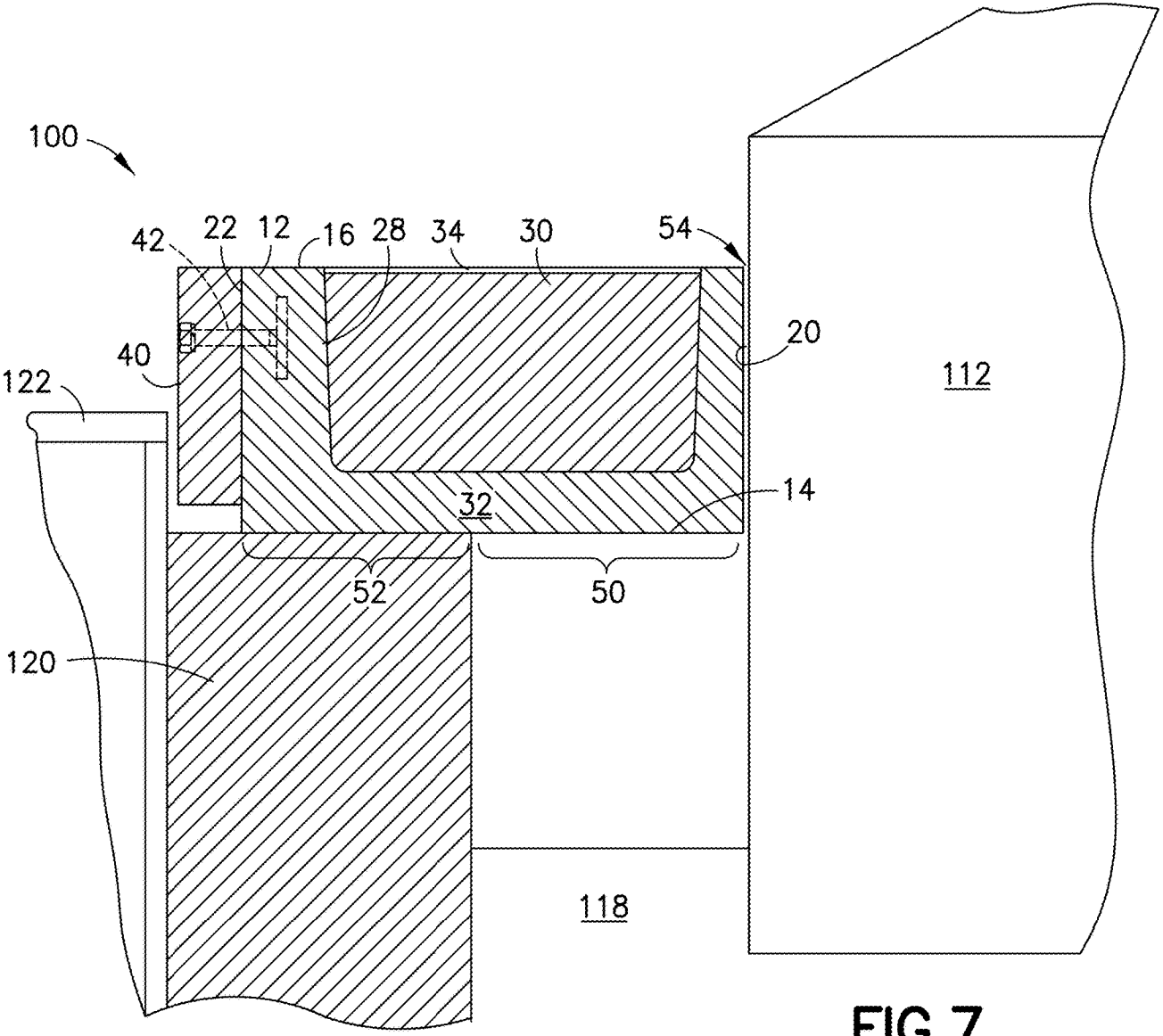
FIG. 7 depicts the insulation assembly of FIG. 6 positioned on an electrolysis cell, depicting a gap between the insulation assembly and the anode surface (e.g. anode assembly, anode body, refractory body, or combination thereof).

FIGS. 6 and 7 depict cut-away side views of another embodiment of an insulation assembly 10, in which the insulation assembly 10 is configured to an attachment area 40 (e.g. a portion of the cell 100, or cell component/superstructure). As depicted in FIGS. 6 and 7, the mechanical attachment device 42 (configured in the form of a bolt or screw 44) attaches the insulation assembly 10 (e.g. outer portion 22) to the attachment area 40 of the cell 100. Also depicted in this embodiment, cover 34 is configured to retain low density insulation material 30 within the recessed portion of body 12 (composed of high density insulation material 32). Thus, FIGS. 6 and 7 depict an insulation assembly 10 configured with two forms of retaining the insulation assembly in place: (a) a specifically configured center of gravity above the contact portion 52 of the lower surface 14 and (b) mechanical attachment device/fastener 42 configured to mechanically attach the insulation assembly 10 to the cell 100 at the attachment area 40 of the sidewall 120. FIG. 7 depicts the insulation assembly 10 in position on the sidewall 120 of the cell, depicting the gap 54 between the inner portion 20 of the sidewall and the anode surface 112.

Figure 8:
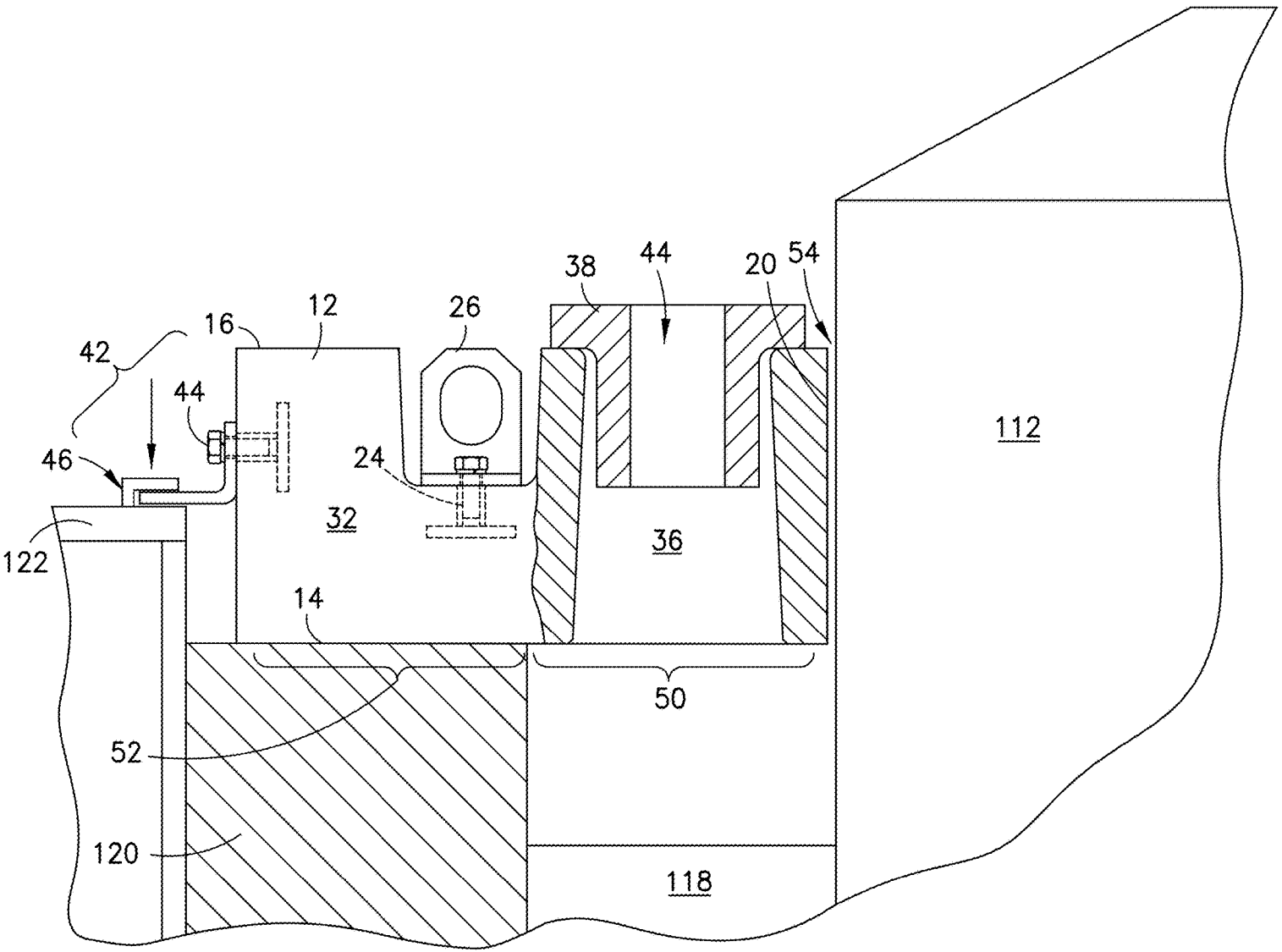
FIG. 8 depicts a cut-away side view of another embodiment of an insulation assembly of the instant disclosure, where the insulation assembly is configured with an attachment area (e.g. mechanical attachment device configured in the form of a bracket and latch).

FIG. 8 depicts a cut-away side view of another embodiment of an insulation assembly 10, where the insulation assembly 10 is configured with a mechanical attachment device 42 which is configured to attach to the attachment area 40 of the sidewall 120 (e.g. specifically, a latch on the deck plate 122). As shown in FIG. 8, the outer portion 22 of the insulation assembly is configured with a mechanical fastener 42 (e.g. a bolt 44 which attaches to a bracket 46). As depicted in FIG. 8, the mechanical fastener 42 (e.g. bracket 46) is configured to cooperate with the latch 46 on the deck plate 122 and retain the insulation assembly 10 in place on the sidewall 120. FIG. 8 also depicts a port 36 configured with a cap 38 with access point 44 and a lift device 26 (i.e. tow hook which is configured with a mechanical fastener in the form of a bolt or screw) configured to attach to the attachment area for the lift device 24.

Figure 9:
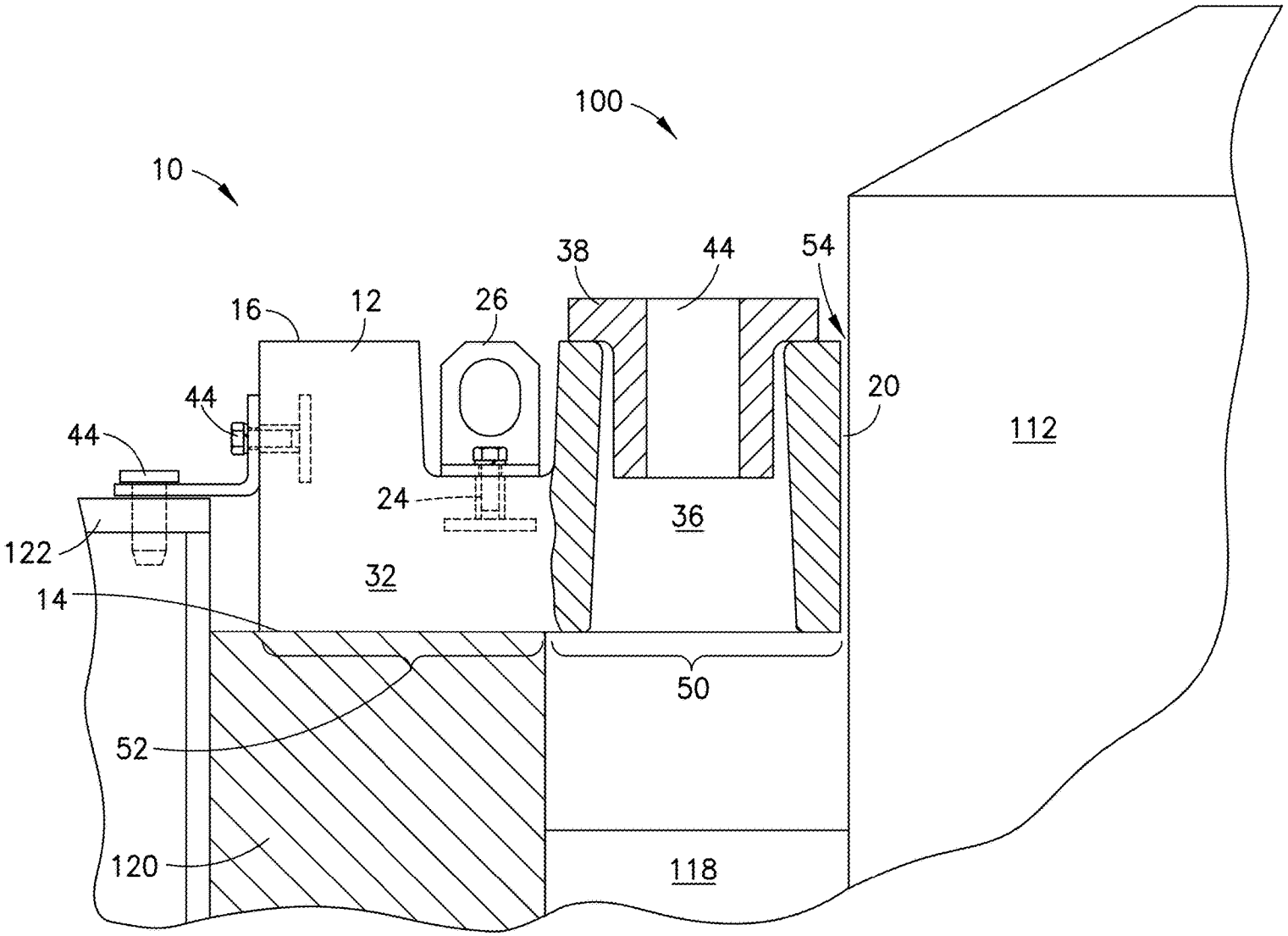
FIG. 9 depicts a cut-away side view of another embodiment of an insulation assembly of the instant disclosure, where the insulation assembly is configured with an attachment area (e.g. mechanical attachment device configured in the form of a bracket combined with a screw or bolt).

FIG. 9 depicts a cut-away side view of another embodiment of an insulation assembly 10, where the insulation assembly 10 is configured with a mechanical attachment device 42 which is configured to attach to the attachment area 40 of the sidewall 120 (e.g. specifically, a mechanical fastener (i.e. bolt or screw) on the deck plate 122). As shown in FIG. 9, the outer portion 22 of the insulation assembly is configured with a mechanical fastener 42 (e.g. a bolt 44 which attaches to a bracket 46). As depicted in FIG. 9, the mechanical fastener 42 (e.g. bracket 46) is attached to the deck plate 122 via bolt or screw 44, thus retaining the insulation assembly 10 in place on the sidewall 120. FIG. 9 also depicts a port 36 configured with a cap 38 with access point 44 and a lift device 26 (i.e. tow hook which is configured with a mechanical fastener in the form of a bolt or screw) configured to attach to the attachment area for the lift device 24.

Figure 11:
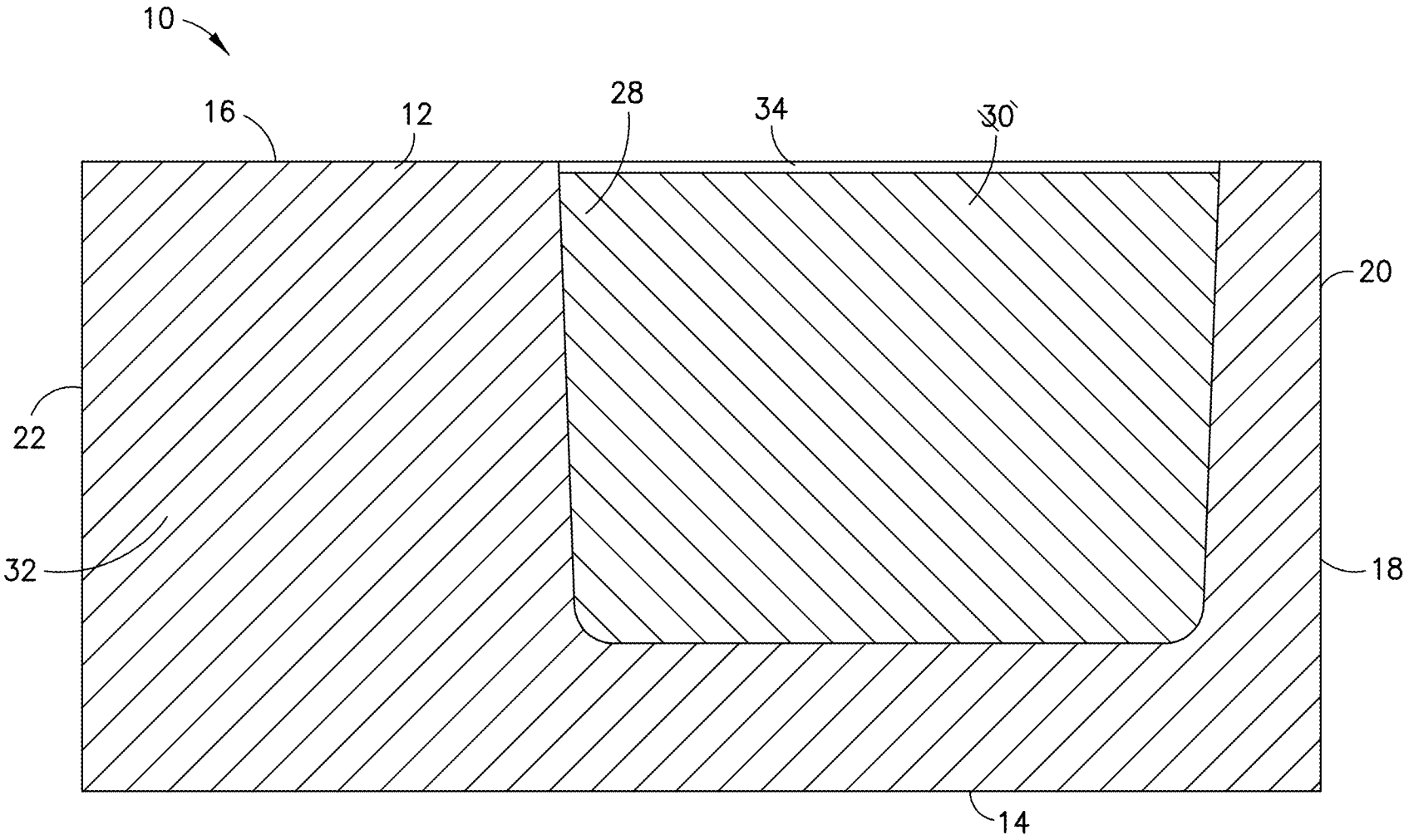
FIG. 11 depicts a cut-away side view of another embodiment of an insulation assembly of the instant disclosure.
Figure 12:
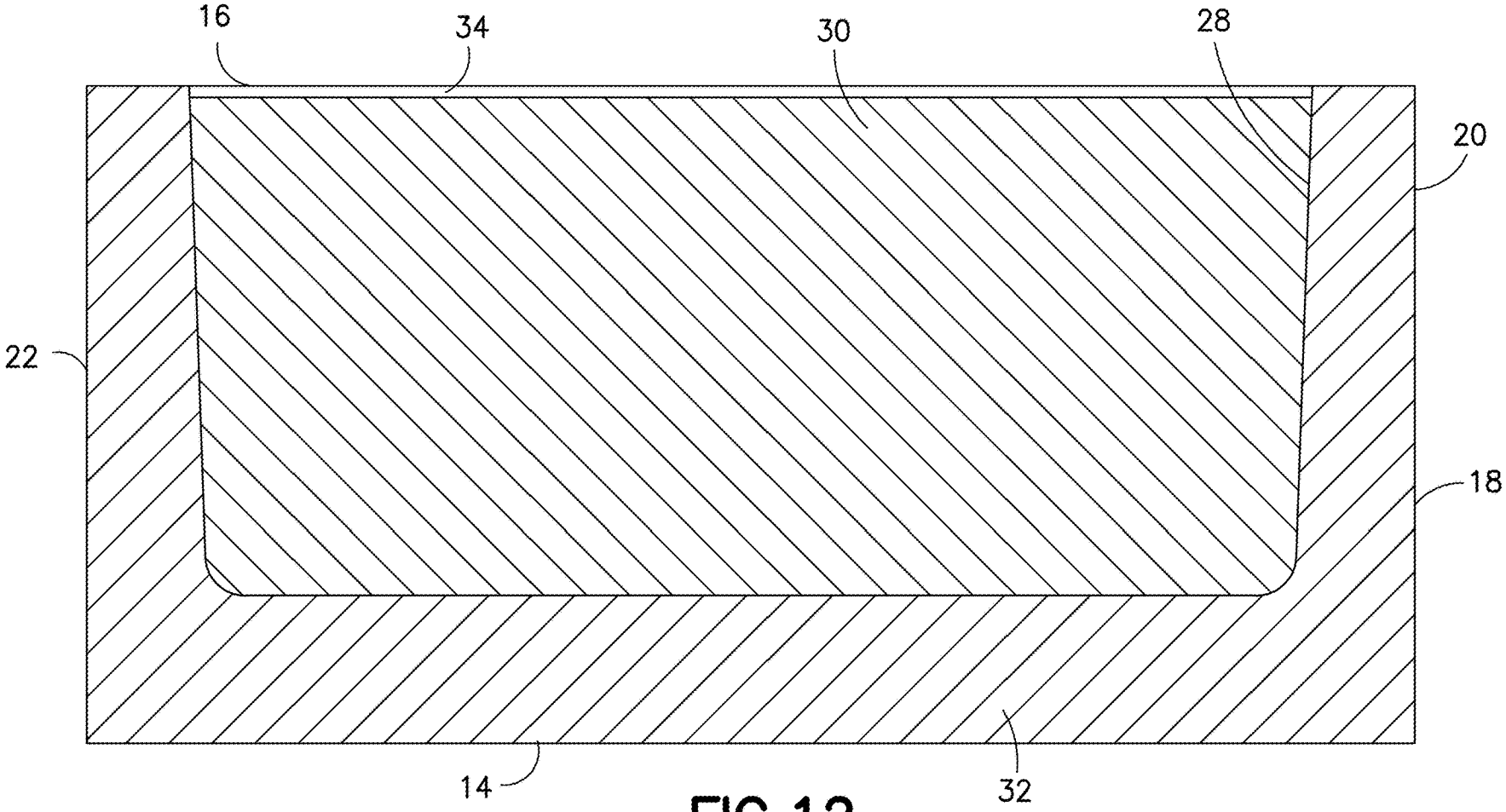
FIG. 12 depicts a cut-away side view of another embodiment of an insulation assembly of the instant disclosure, similar to that of FIG. 11, but with a larger volume of low density insulation as compared to that of FIG. 11.

FIGS. 11 and 12 are similar in that each depicts an insulation assembly 10 having a low density insulation portion 30 retained within a depression/recessed portion 28 of the body 12, which is covered/retained by cover 34. FIG. 11 depicts a smaller volume of low density insulation material 30 (e.g. primarily positioned above the overhang portion 50 of the insulation assembly, adjacent to the inner portion 20) as compared to FIG. 12, which provides a larger cross sectional volume of low density insulation material 30*s* (e.g. filling the majority of the cross-sectional volume of the insulation assembly 10).

Figure 13:
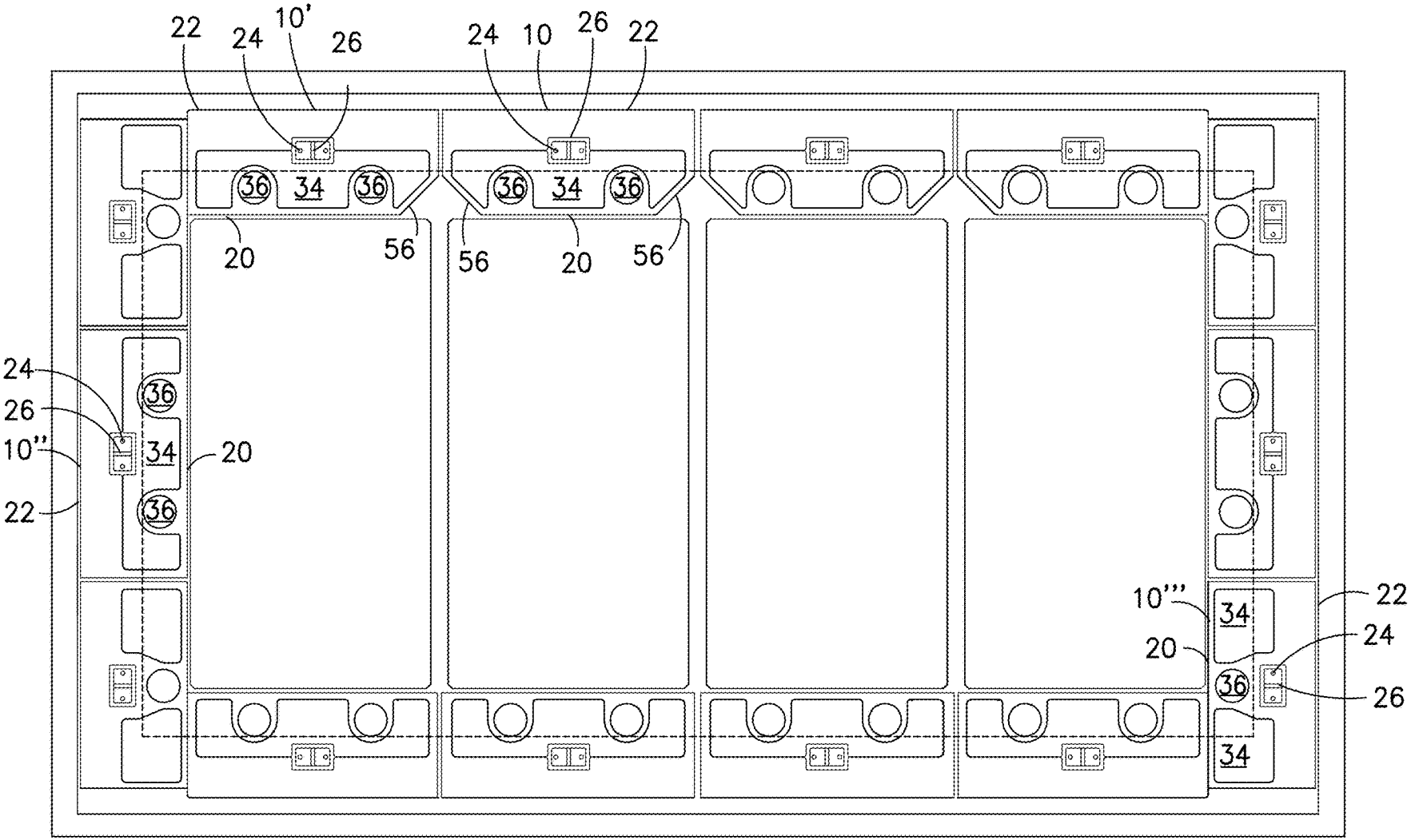
FIG. 13 depicts a top plan view of an electrolysis cell configured with a plurality of insulation assemblies, where four different configurations of insulation assemblies are depicted.

FIG. 13 depicts a top plan view of an electrolysis cell 100 configured with a plurality of insulation assemblies 10, where four different configurations of insulation assemblies 10 are depicted. Referring to FIG. 13, the insulation assemblies 10 are configured along the outer perimeter of the cell (e.g. sidewalls and corners) such that the plurality of insulation assemblies 10 configured to cooperate with the anode surfaces 112 (e.g. anode assemblies and/or anode bodies) to form a perimetrical cover which is configured to reduce, prevent, or eliminate heat loss from the cell. Also, it is noted that the insulation assemblies 10 cooperate with the anode surfaces to provide a gap between the inner portion 20 of each insulation assembly 10 and the anode surface 112, in addition to a gap between the sidewall 18 of each insulation assembly 10 (as two are placed adjacent to/in proximity to each other).

Referring to insulation assembly 10, the assembly 10 is configured with two ports 36 and a cover 34 which extends around the rear of the ports 36 to the lift device 26. It is noted that the inner portion 20 of the insulation assembly 10 is configured with two angled corners 58 of the inner portion. In some embodiments, the angled corners 58 are configured to enable instruments and/or feed devices to be positioned or samples/measurements to be taken at varying positions along the top of the cell (i.e. between insulation assemblies 10 and anode surfaces 112).

Referring to insulation assembly 10', the assembly 10' is configured similarly to insulation assembly 10, but with only one angled corner 58 (e.g. as in this configuration, the insulation assembly 10' is adjacent to a corner of the cell).

Referring to insulation assembly 10", the assembly 10" is configured similarly to insulation assembly 10' and 10, but with no angled corner 58 along the inner portion 20 of the insulation assembly 10".

Referring to insulation assembly 10'", the assembly 10'" is configured similarly to insulation assembly 10' and 10, but with no angled corners 58, only one port 36, and two covers 34 as opposed to one cover 34 (such that a smaller cross sectional volume of low density insulation material is present as compared to insulation assembly 10, 10' and 10", and wherein 10'" has two recessed portions 28 each equipped with low density insulation material 30) as opposed to the one cover 34).

Example: Manufacture of Insulation Assembly

The body is a pre-fired, pre-cast piece of refractory material. The body is machined or pre-cast to form the depression in the upper surface. The low density insulation material (e.g. thermal blanket) is positioned inside the depression and the cover is attached to retain the thermal blanket inside of the body. The lifting lug is attached to the upper surface of the assembly.

While various embodiments of the present invention have been described in detail, it is apparent that modifications and adaptations of those embodiments will occur to those skilled in the art. However, it is to be expressly understood that such modifications and adaptations are within the spirit and scope of the present invention.

REFERENCE NUMBERS

Insulation assembly 10
Body 12
Lower surface 14
Overhang portion of lower surface 50
Contact portion of lower surface 52
Upper surface 16
Perimetrical Sidewall 18
Inner portion 20
Angled corner of inner portion 58
Outer portion 22
Attachment area for lift device 24
Lift device 26
Depression 28
Low density insulation 30
High density insulation 32
Cover 34
Port 36
Cap 38
Cap access point 44
Attachment area (to attach assembly to cell wall) 40
Mechanical fastener 42
Bracket 46
Bolt or screw 44
Gap 54
Cell 100
Anode surface 112 (e.g. either anode body 114 or anode assembly (refractory) 116)
Bath 118
Sidewall 120
Deck plate 122

What is claimed is:

1. An insulation assembly, comprising:

a body of an insulating material extending from a sidewall towards an anode surface of a cell assembly, the body having:

a lower surface defining a contact portion and an overhang portion, wherein the contact portion is configured to contact the sidewall of the electrolysis cell, and the overhang portion is configured to extend in an outward direction from the sidewall above a bath of the electrolysis cell;

an upper surface generally opposed to the lower surface; and a perimetrical sidewall extending between the upper surface and the lower surface, wherein the perimetrical sidewall includes an inner portion, wherein the inner portion faces the anode surface of the electrolysis cell, wherein the inner surface is constructed of a non-metallic material;

wherein the body has a center of gravity located above the contact portion of the lower surface, such that the insulation assembly is retained in place on the sidewall via gravity with the overhang portion overhanging the bath of the cell and a gap is formed between the inner portion and the anode surface of the electrolysis cell, wherein the gap is from 2 mm to 10 mm.

2. The assembly of claim 1, wherein the gap self-seals with solidified bath.

3. The assembly of claim 1, wherein the body has a thickness of from 25.4 mm to 254 mm.

4. The assembly of claim 1, wherein the insulation assembly comprises aside aisle refractory block.

5. The assembly of claim 1, wherein the body comprises: refractory, alumina based refractory, castable, silica, aluminosilicates, calcium aluminates, or combinations thereof.

6. The assembly of claim 1, wherein the lower surface comprises a non-metallic material.

7. The assembly of claim 1, wherein the upper surface comprises a lift point.

8. The assembly of claim 7, wherein the lift point comprises an attachment site configured to allow attachment to the body, wherein the attachment site is configured to support the weight of the body.

9. The assembly of claim 1, wherein the body comprises a port extending through the body from the upper surface to the lower surface.

10. The assembly of claim 9, wherein the port is configured to support and permit at least one of the following to extend therethrough: an alumina feed device, a sensor, a probe, a tapping rod/device, a thermocouple, a sampling container, and combinations thereof.

11. The assembly of claim 9, wherein the body comprises a port, wherein the assembly comprises a cap, wherein the cap is sized to fit into and be retained in the port of the body.

12. The assembly of claim 11, wherein the cap comprises a refractory material, wherein the refractory material comprises: alumino-silicate material, low-cement alumina, or combinations thereof.

13. The assembly of claim 11, wherein the cap is retained in the port via gravity.

14. The assembly of claim 11, wherein the cap is retained in the port via a press-fit.

15. The assembly of claim 1, wherein the body comprises: a low density insulating material and a high density insulating material, wherein the lower surface and the perimetrical sidewall comprise the high density insulating material.

16. The assembly of claim 1, wherein the body comprises a depression above the overhang portion extending from the upper surface, wherein a low density insulating material is retained within the depression.

17. The assembly of claim 16, wherein the low density insulating material comprises at least one of: a thermal blanket; an alumina blanket; a silica based blanket; and combinations thereof.

18. The assembly of claim 15, wherein the assembly comprises a cross-sectional volume, wherein the low density insulating material comprises at least 10% of the cross-sectional volume, and wherein the balance of the cross-sectional volume comprises the high density insulating material.

19. The assembly of claim 15, wherein the assembly comprises a cross-sectional volume, wherein the low density insulating material comprises not greater than 70% of the cross-sectional volume, and wherein the balance of the cross-sectional volume comprises the high density insulating material.

20. The assembly of claim 16, wherein the depression is proximal to the inner surface of the sidewall.

21. The assembly of claim 16, further comprising a cover configured to fit over the depression in the upper surface and retain the low density insulating material inside of the depression.

22. The assembly of claim 21, wherein the cover comprises: metal, stainless steel, aluminum, mild steel, refractory castable, refractory board, or combinations thereof.

23. The assembly of claim 1, wherein the body comprises a monolithic piece and a depression, wherein the depression is located in the upper surface over the overhang portion.

24. The assembly of claim 1, wherein the body comprises a mechanical attachment to a deck plate.

25. An insulation assembly, comprising:

a monolithic body of an insulating material, wherein the monolithic body comprises:

a lower surface, wherein the lower surface comprises a non-conducting material, and wherein the lower surface has a contact portion configured to contact an upper portion of a sidewall of an electrolysis cell;

an upper surface generally opposed from the lower surface, wherein the upper surface comprises a lift device, wherein the lift device comprises an attachment site configured to allow attachment to the monolithic body and support the weight of the monolithic body when lifted from contact with a deck plate of the electrolysis cell; and a perimetrical sidewall extending between the upper surface and the lower surface, wherein the perimetrical sidewall comprises an inner portion facing the open upper region of the electrolysis cell, wherein the inner surface comprises an insulating material;

wherein the body has a center of gravity located above the contact portion of the lower surface such that the insulation assembly is retained in place on the sidewall via gravity, and wherein the monolithic body forms a gap with an anode assembly of the electrolysis cell, wherein the gap is from 2 mm to 10 mm.

26. An apparatus, comprising:

an electrolysis cell comprising:

(a) a cell bottom;

(b) at least one anode;

(c) at least one cathode; and (d) at least one sidewall perimetrically surrounding the cell bottom, wherein the sidewall comprises:

(i) an inner face configured to retain a molten electrolyte;

(ii) a top edge; and (iii) an upper portion;

(e) at least one insulation assembly configured to fit on the top edge of the sidewall, the at least one insulation assembly having a center of gravity located above the top edge of the sidewall such that the insulation assembly is retained in place on the sidewall via gravity, wherein the at least one insulation assembly forms a gap of from 2 mm to 10 mm with the at least one anode, wherein the insulation assembly comprises:

(i) a body, wherein the body comprises a non-metallic material, and wherein the body comprises a lower surface contacting the top edge of the sidewall and an upper surface comprises a lift device.

27. The apparatus of claim 26, wherein the gap self-seals with a solidified bath material from the cell.

28. The apparatus of claim 26, wherein the body has a thickness of from 23.4 mm to 254 mm.

29. The apparatus of claim 26, wherein the body comprises a port extending through the body from the upper surface to the lower surface.

30. The apparatus of claim 29, wherein the port is configured to support and permit at least one of the following to extend therethrough: an alumina feed device, a sensor, a probe, a tapping rod/device, a thermocouple, a sampling container, and combinations thereof.

31. The apparatus of claim 26, wherein the body comprises a port, wherein the assembly comprises a cap, wherein the cap is sized into and be retained in the port of the body.

32. The apparatus of claim 26, wherein the body comprises cantilevered configuration, wherein the inner edge of the body is unsupported.

* * * * *